US010668596B2

(12) United States Patent
Usui et al.

(10) Patent No.: US 10,668,596 B2
(45) Date of Patent: Jun. 2, 2020

(54) SURFACE TREATMENT DEVICE AND SURFACE TREATMENT METHOD

(71) Applicant: Nissan Motor Co., Ltd., Yokohama-shi, Kanagawa (JP)

(72) Inventors: Katsuhiro Usui, Kanagawa (JP); Takeshi Nagao, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 290 days.

(21) Appl. No.: 15/768,593

(22) PCT Filed: Nov. 9, 2015

(86) PCT No.: PCT/JP2015/081500

§ 371 (c)(1),
(2) Date: Apr. 16, 2018

(87) PCT Pub. No.: WO2017/081730

PCT Pub. Date: May 18, 2017

(65) Prior Publication Data

US 2018/0297172 A1 Oct. 18, 2018

(51) Int. Cl.

| | |
|---|---|
| ***B24C 5/04*** | (2006.01) |
| ***B24C 1/06*** | (2006.01) |
| ***B24C 9/00*** | (2006.01) |
| ***B24C 5/02*** | (2006.01) |

(52) U.S. Cl.
CPC ..... *B24C 5/04* (2013.01); *B24C 1/06* (2013.01); *B24C 5/02* (2013.01); *B24C 9/00* (2013.01)

(58) Field of Classification Search
CPC .... B24C 5/04; B24C 1/06; B24C 5/02; B24C 9/00
See application file for complete search history.

(56) References Cited

U.S. PATENT DOCUMENTS 2,644,275 A * 7/1953 Hoguet ..... B24C 7/0084 451/102
4,654,925 A * 4/1987 Grave ..... A47L 11/30 15/322
4,976,005 A * 12/1990 Graye ..... A47L 9/02 15/322
5,833,521 A * 11/1998 McPhee ..... B24C 3/06 451/87

(Continued)

FOREIGN PATENT DOCUMENTS

JP H06-190308 A 7/1994
JP 2001-334466 A 12/2001

*Primary Examiner* — Dung Van Nguyen
(74) *Attorney, Agent, or Firm* — Global IP Counselors, LLP

(57) ABSTRACT

A surface treatment device includes a vacuum blast head, an air curtain-forming unit and an auxiliary air injection unit. The vacuum blast head includes an injection nozzle and a suction hole. The injection nozzle injects a polishing agent used for blast treatment on a surface of a material to be treated. The suction hole sucks up the injected polishing agent with suction air. The air curtain-forming unit injects air toward the surface of the material to be treated to form an air curtain that surrounds the injected polishing agent. The auxiliary air injection unit injects auxiliary air between the air curtain and the suction air toward the material to be treated at a lower pressure than the air that forms the air curtain.

8 Claims, 7 Drawing Sheets

(56) References Cited

U.S. PATENT DOCUMENTS

| | | | | |
|---|---|---|---|---|
| 6,012,975 | A * | 1/2000 | Jager | B24C 5/04 451/87 |
| 8,801,499 | B2 * | 8/2014 | Yoshizawa | B24C 9/003 451/38 |
| 2005/0076937 | A1 * | 4/2005 | Jung | G21F 9/001 134/37 |
| 2011/0186436 | A1 | 8/2011 | Novosselov et al. | |

* cited by examiner

SURFACE TREATMENT DEVICE AND SURFACE TREATMENT METHOD

CROSS-REFERENCE TO RELATED APPLICATIONS

This application is a U.S. National stage application of International Application No. PCT/JP2015/081500, filed on Nov. 9, 2015.

BACKGROUND

Field of the Invention

The present invention relates to a surface treatment device and a surface treatment method.

Background Information

In recent years, for reasons of weight reduction, carbon fiber-reinforced plastic (CFRP) is being used in vehicle body structures. When manufacturing a vehicle body structure from CFRP, members are bonded with an adhesive. In this case, as a pretreatment for adhesion, the surface of the material to be treated as a member is subjected to blast treatment by means of a vacuum blast treatment.

In a vacuum blast treatment, a polishing agent is injected onto the material to be treated to roughen the surface of the material to be treated, to thereby increase the adhesion area and improve the bonding strength. In addition, the polishing agent sprayed onto the material to be treated, as well as dust, etc., generated by spraying the polishing agent on the material to be treated, is drawn up; the polishing agent is separated from the dust, etc.; and the polishing agent is recovered so that the polishing agent can be reused.

As described above, since blast treatment is carried out by reusing the polishing agent in a vacuum blast treatment, it is required that the polishing agent be efficiently recovered.

In this regard, for example, Japanese Laid-Open Patent Application No. 2001-334466 (Patent Document 1) discloses a method in which the blast treatment of a material to be treated is carried out by enclosing the injection nozzle and the entire material to be treated within a treatment chamber.

SUMMARY

However, since a treatment chamber for enclosing the material to be treated is required in the method disclosed in Patent Document 1, there is the problem that the device configuration becomes complicated.

In order to solve the problem described above, an object of the present invention is to provide a surface treatment device and a surface treatment method capable of efficiently recovering the polishing agent without complicating the device configuration.

The surface treatment device according to the present invention which realizes the object described above comprises a vacuum blast head, an air curtain-forming unit, and an auxiliary air injection unit. The vacuum blast head comprises an injection nozzle for spraying a polishing agent used for blast treatment onto the surface of a material to be treated, and a suction hole for suctioning the injected polishing agent with suction air. The air curtain-forming unit injects air toward the surface of the material to be treated to form an air curtain that surrounds the injected polishing agent. The auxiliary air injection unit injects auxiliary air between the air curtain and the suction air towards the material to be treated at a lower pressure than the air forming the air curtain.

In addition, in the surface treatment method according to the present invention which realizes the object described above, a polishing agent used for blast treatment is sprayed onto the surface of a material to be treated and the injected polishing agent is drawn up with suction air. Air is injected toward the surface of the material to be treated to form an air curtain that surrounds the injected polishing agent. Auxiliary air is injected between the air curtain and the suction air towards the material to be treated at a lower pressure than the air forming the air curtain.

According to the surface treatment device and the surface treatment method described above, the space into which polishing agent is sprayed is surrounded by an air curtain. Thus, the blast space in which a blast treatment is carried out can be formed within a closed space. Therefore, it is possible to prevent the polishing agent from being discharged from the blast space to the outside. Additionally, the auxiliary air is injected toward the material to be treated between the air curtain and the suction air. Thus, auxiliary air is injected onto the polishing agent that remains between the air curtain and the suction air. At this time, since the pressure of the auxiliary air is lower than the pressure for forming the air curtain, it is possible to form a stable blast space. As a result, the remaining polishing agent is released from a static condition and recovered by the suction air via the suction hole. Therefore, it is possible to efficiently recover the polishing agent. In addition, since a treatment chamber to enclose the injection nozzle and all of the material to be treated need not be provided, it is possible to avoid a complex device configuration. Therefore, it is possible to provide a surface treatment device and a surface treatment method capable of efficiently recovering the polishing agent without resorting to a complex device configuration.

DETAILED DESCRIPTION OF EMBODIMENTS

Figure 1:
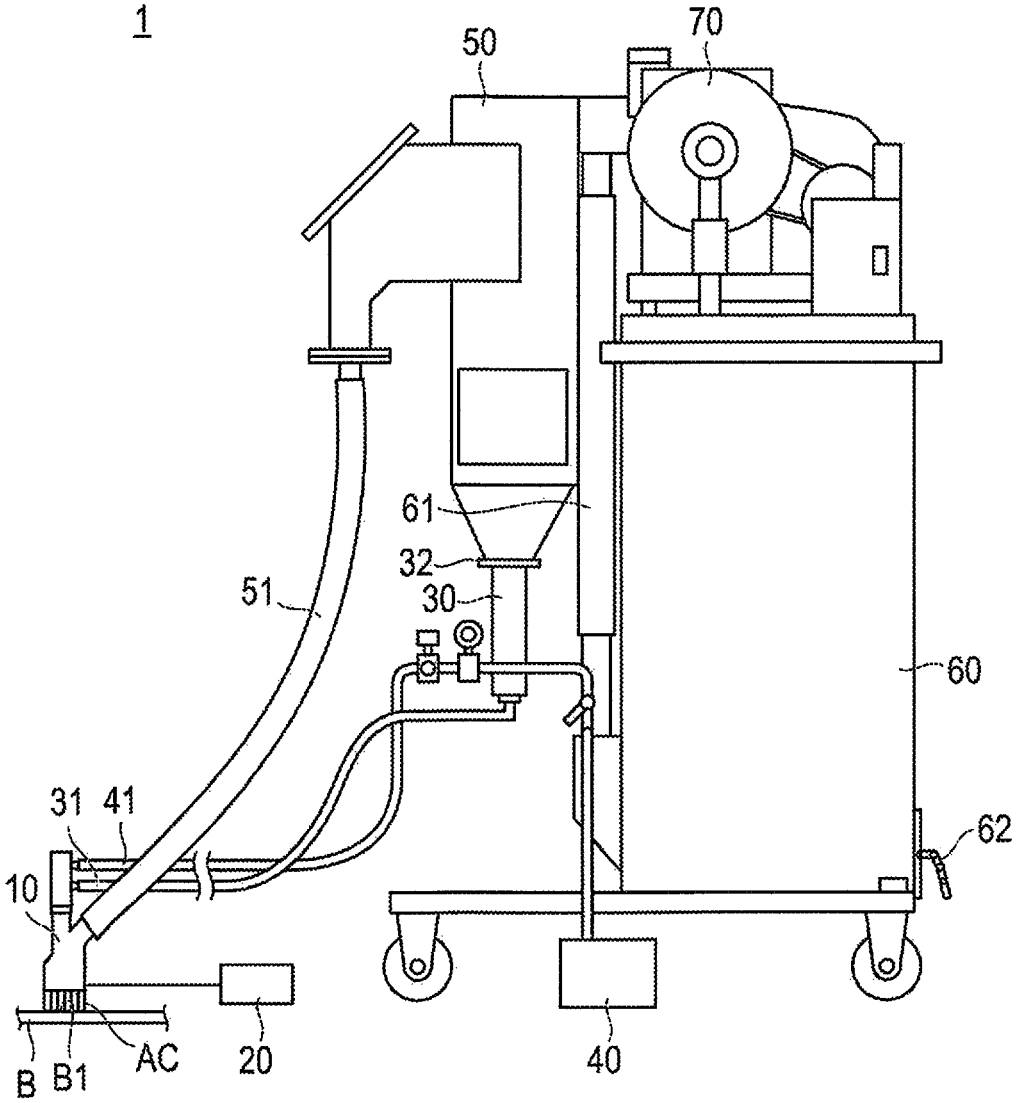
FIG. 1 is a view illustrating a surface treatment device according to the present embodiment.

Embodiments of the present invention will be explained below with reference to the appended drawings. In the explanations of the drawings, identical elements are given the same reference symbols and redundant explanations are omitted. The dimensional ratios used in the drawings may be exaggerated for the sake of convenience of the explanation and may differ from the actual ratios.

The surface treatment device 1 according to the present embodiment is a vacuum blast device. In general, the surface treatment device 1 sprays a polishing agent onto a material B to be treated and subjects the surface B1 of the material B to be treated to blast treatment to thereby roughen the surface B1 of the material B to be treated. By roughening the surface B1 of the material B to be treated, the adhesion area increases and the bonding strength by means of the adhesive is improved. In addition, the surface treatment device 1 recovers the polishing agent sprayed onto the material B to be treated, as well as dust, etc., generated by spraying the polishing agent on the material B to be treated, and separates the polishing agent from the dust, etc. Thus, only the polishing agent that can be reused is recovered for reuse.

Examples of a material B to be treated include automobile parts made of CFRP, but no limitation is imposed thereby.

Examples of the polishing agent include alumina ($Al_2O_3$), carborundum, river sand, quartz sand, and emery, but from the standpoint of being economical and having a high blast treatment, alumina is preferable.

Figure 2:
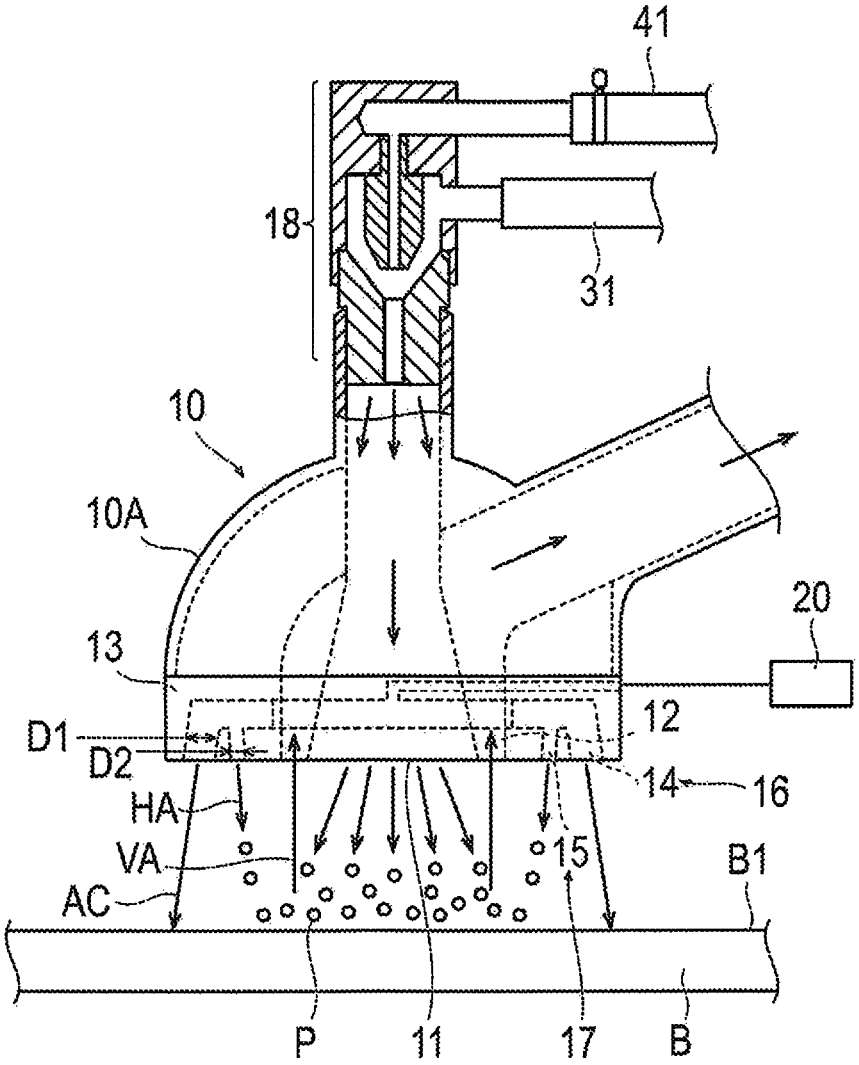
FIG. 2 is a view illustrating a vacuum blast head and an air supply source of the surface treatment device.
Figure 3:
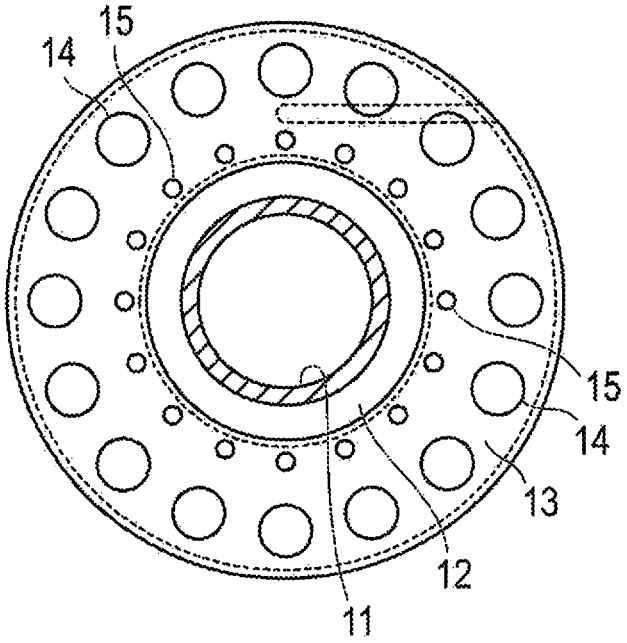
FIG. 3 is a view of the vacuum blast head as viewed from the side of the material to be treated.

FIG. 1 is a view illustrating a surface treatment device 1 according to the present embodiment. FIG. 2 is a view illustrating a vacuum blast head 10 and an air supply source 20. FIG. 3 is a view of the vacuum blast head 10 as viewed from the side of the material B to be treated.

The surface treatment device comprises a vacuum blast head 10 that sprays a polishing agent P to roughen the surface B1 of the material B to be treated, as illustrated in FIG. 1 and FIG. 2. The surface treatment device 1 comprises an air supply source 20 that supplies air to an air curtain-forming hole 14 of the vacuum blast head 10 and an auxiliary air injection hole 15. In addition, the surface treatment device 1 comprises a polishing agent tank 30 in which the polishing agent P is stored, and a compressor 40 for supplying compressed air to the injection nozzle 11. Additionally, the surface treatment device 1 comprises a recovery tank 50 for recovering the polishing agent P that has been sprayed onto the material B to be treated, and a dust collector 60 for collecting dust, etc., that is generated by spraying the polishing agent P on the material B to be treated. In addition, the surface treatment device 1 comprises an exhauster 70 that forms a negative pressure inside the recovery tank 50 and the dust collector 60.

The vacuum blast head 10 comprises a main body 10A having a curved shape, an injection nozzle 11 from which the polishing agent P is injected, and a suction hole 12 for suctioning the polishing agent P sprayed onto the material B to be treated, as illustrated in FIG. 2 and FIG. 3. In addition, the vacuum blast head 10 comprises a ring plate 13 that is provided on the lower portion of the main body 10A, and a connecting portion 18 that is provided above the injection nozzle 11.

The injection nozzle 11 is connected to the polishing agent tank 30 via the connecting portion 18 and a polishing agent hose 31. In addition, the injection nozzle 11 is connected to the compressor 40 via the connecting portion 18 and an air hose 41. The polishing agent hose 31 and the air hose 41 are flexible rubber tubes.

In an injection nozzle 11 configured in this manner, compressed air is supplied to the connecting portion 18 from the compressor 40 via the air hose 41. The pressure inside the connecting portion 18 thereby becomes negative, so that the polishing agent P inside the polishing agent tank 30 is drawn into the connecting portion 18 via the polishing agent hose 31. Then, the polishing agent P is sprayed from the injection nozzle 11 toward the material B to be treated. As a result, the surface B1 of the material B to be treated is subjected to blast treatment, and the surface B1 of the material B to be treated is roughened.

A vacuum hose 51 is connected between the suction hole 12 and the recovery tank 50, as illustrated in FIG. 1 and FIG. 2. The polishing agent P that is sprayed from the injection nozzle 11 is drawn into the recovery tank 50 by suction air VA via the vacuum hose 51. The vacuum hose 51 is a flexible rubber tube.

The ring plate 13 is connected to the main body 10A. The method of connecting the main body 10A and the ring plate 13 is not particularly limited. The ring plate 13 comprises an air curtain-forming hole 14 for forming an air curtain AC, and an auxiliary air injection hole 15 for injecting auxiliary air HA, as illustrated in FIG. 2.

A plurality of the air curtain-forming holes 14 are formed on the radially outer side of the ring plate 13 along the circumferential direction, as illustrated in FIG. 3. The air curtain-forming holes 14 configure an air curtain-forming unit 16 together with the air supply source 20.

By being supplied air from the air supply source 20, the air curtain-forming unit 16 injects air toward the surface B1 of the material B to be treated to form an air curtain AC that surrounds the injected polishing agent P. The pressure of the air that forms the air curtain AC is, for example, 1-3 MPa, but no limitation is imposed thereby.

The air curtain AC formed by the air curtain-forming unit 16 is formed so as to incline outwardly as the air curtain approaches the surface B1 of the material B to be treated, as illustrated in FIG. 2. Thus, it is possible to prevent interference between the air curtain AC and the auxiliary air HA and to form a stable blast space.

A plurality of the auxiliary air injection holes 15 are formed in the radially inner side of the ring plate 13 along the circumferential direction, as illustrated in FIG. 3. The auxiliary air injection holes 15 configure an auxiliary air injection unit 17 together with the air supply unit 20.

By air being supplied from the air supply source 20, the auxiliary air injection unit 17 injects auxiliary air HA toward the material B to be treated between the air curtain AC and the suction air VA. The diameter D2 of the auxiliary air injection hole 15 is configured to be smaller than the diameter D1 of the air curtain-forming hole 14, as illustrated in FIG. 2. Thus, auxiliary air HA that is at a lower pressure than the air that forms the air curtain AC is injected from the auxiliary air injection hole 15. The pressure of the auxiliary air HA is, for example, 0.1 MPa, but no limitation is imposed thereby. In this manner, by setting the pressure of the auxiliary air HA lower than the pressure of the air that forms the air curtain AC, it is possible to form a stable blast space.

The auxiliary air HA that is injected by the auxiliary air injection unit 17 is injected so as to incline inwardly as the auxiliary air approaches the surface B1 of the material B to be treated, as illustrated in FIG. 2. Thus, it is possible to move the polishing agent P that remains between the air curtain AC and the suction air VA inward from the blast space on which the suction air VA acts. Therefore, it is possible to suitably suction the polishing agent P that has been moved inwards. Therefore, the recovery efficiency of the polishing agent P is improved.

The polishing agent P is stored in the polishing agent tank 30. The recovery tank 50 is disposed above the polishing agent tank 30 and is connected thereto via a dump valve 32. The dump valve 32 is opened and closed by means of a solenoid valve (not shown).

The recovery tank 50 recovers the polishing agent P that is sprayed onto the material B to be treated, and the dust, etc., that is generated by spraying the polishing agent P onto the material B to be treated via the suction hole 12 of the vacuum blast head 10. The recovery tank 50 is configured from a cyclone separator that separates the polishing agent P from the dust, etc. As described above, the recovery tank 50 is connected to the polishing agent tank 30 via the dump valve 32. Of the polishing agent P and the dust, etc., that are separated in the recovery tank 50, the reusable polishing agent P remains in the recovery tank 50 and is moved to the polishing agent tank 30 when the dump valve 32 is opened.

The dust collector 60 collects the dust, etc., that has been separated in the recovery tank 50 via a pipe 61. A dust box 62 for collecting dust, etc., is provided in the bottom portion of the dust collector 60. The dust box 62 is removably provided in order to discard the dust, etc.

The exhauster 70 is disposed on the upper portion of the dust collector 60. The exhauster 70 is rotated by a motor, which is not shown, and forms a negative pressure inside the dust collector 60, the recovery tank 50, and the vacuum hose 51. Thus, an air current is generated, from the inside of the blast space to the vacuum hose 51, the recovery tank 50, and the dust collector 60, in that order. Therefore, it is possible to generate suction air VA toward the suction hole 12 in the blast space and to draw up the polishing agent P that is sprayed onto the material B to be treated as well as the dust, etc.

Figure 4:
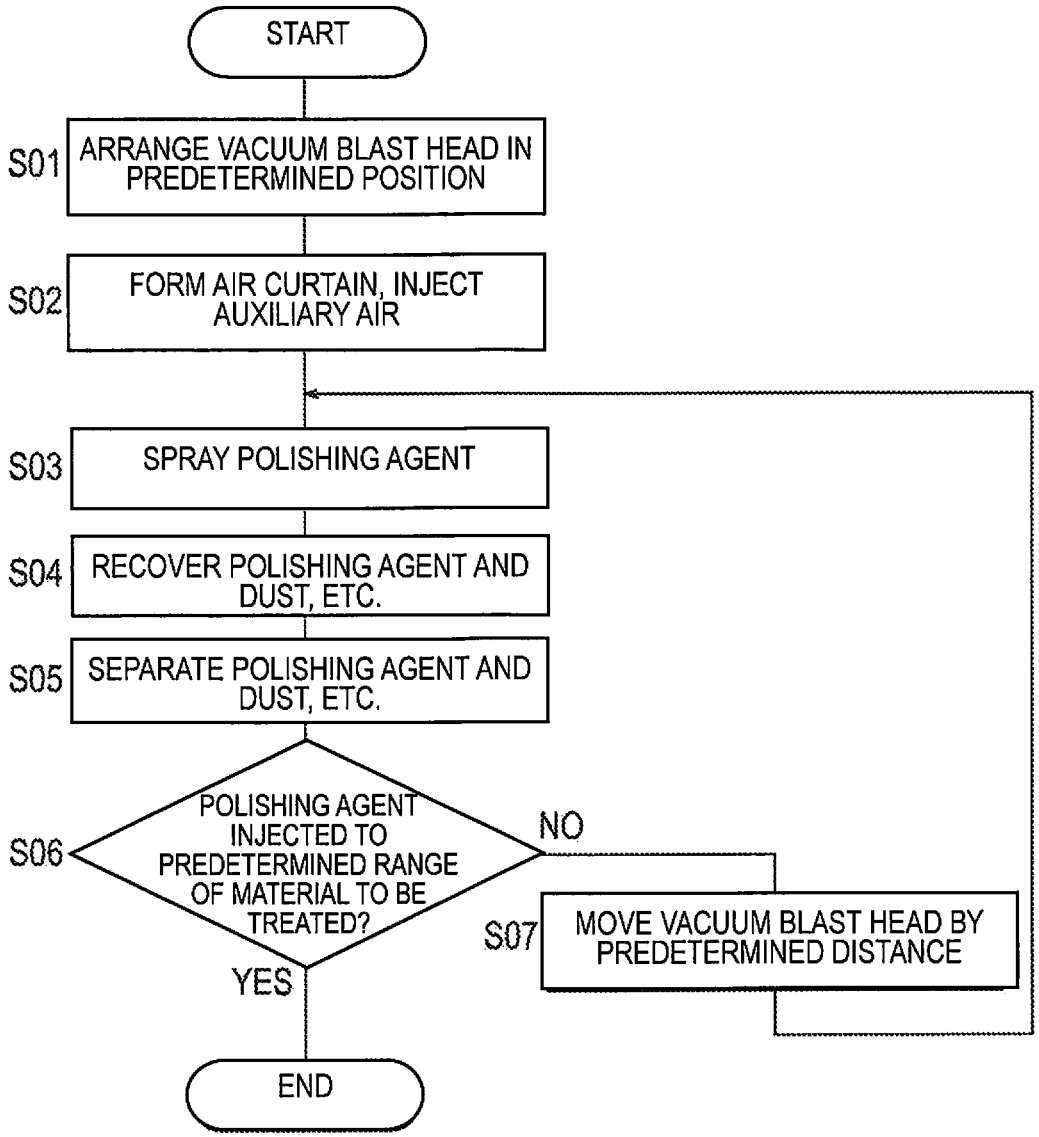
FIG. 4 is a flowchart illustrating a surface treatment method according to the present embodiment.

Next, the surface treatment method using the surface treatment device 1 according to the present embodiment will be described with reference to the flowchart of FIG. 4.

First, the vacuum blast head 10 is disposed in a predetermined position above the surface B1 of the material B to be treated (S01).

Next, an air curtain AC is formed and auxiliary air HA is injected (S02). Specifically, an air curtain AC is formed by supplying air from the air supply source 20 to the air curtain-forming hole 14. In addition, auxiliary air is injected by supplying air from the air supply source 20 to the auxiliary air injection hole 15.

Next, the polishing agent P is sprayed (S03). Specifically, compressed air is supplied to the interior of the connecting portion 18 from the compressor 40 via the air hose 41. The interior pressure of the connecting portion 18 and the polishing agent hose 31 becomes negative due to the compressed air. Then, the polishing agent P inside the polishing agent tank 30 is suctioned and sprayed toward the material B to be treated from the injection nozzle 11. As a result, the surface B1 of the material B to be treated is subjected to blast treatment, and the surface B1 of the material B to be treated is roughened. At this time, the dump valve 32 that is disposed above the polishing agent tank 30 is closed and the connection between the recovery tank 50 and the polishing agent tank 30 is cut off.

In this manner, by forming an air curtain AC and spraying the polishing agent P while injecting auxiliary air HA, the space where the polishing agent is sprayed is surrounded by the air curtain AC, as illustrated in FIG. 2. Thus, the blast space in which blast treatment is carried out can be made into an enclosed space. Therefore, it is possible to prevent the polishing agent P from being discharged from the blast space to the outside. Additionally, the auxiliary air HA is injected toward the material B to be treated between the air curtain AC and the suction air VA. Thus, auxiliary air HA can be injected onto the polishing agent P that remains between the air curtain AC and the suction air VA. As a result, the remaining polishing agent P is released from a static condition and is drawn up by the suction air VA via the suction hole 12. Therefore, it is possible to efficiently recover the polishing agent P.

Next, the polishing agent P that is sprayed onto the surface B1 of the material B to be treated and the dust, etc., are recovered (S04). Specifically, suction air VA is generated by rotating the exhauster 70 and negative pressure is formed inside the dust collector 60, the pipe 61, the recovery tank 50, and the vacuum hose 51. As a result, the polishing agent P that is sprayed onto the material B to be treated and the dust, etc., are recovered into the recovery tank 50 via the vacuum hose 51.

Next, the polishing agent P and the dust, etc., are separated in the recovery tank 50 (S05). The dust, etc., that has been separated in the recovery tank 50 is transported to the dust collector 60 via the pipe 61. The dust, etc., then accumulates in the dust box 62, and clean air is exhausted into the atmosphere from the exhauster 70. On the other hand, the reusable polishing agent P that is separated in the recovery tank 50 remains in the lower portion of the recovery tank 50.

Next, it is determined whether or not the polishing agent P has been sprayed over a predetermined range of the material B to be treated (S06). If it is determined that the polishing agent P has not been sprayed over the predetermined range of the material B to be treated (S06: NO), the vacuum blast head 10 is moved a predetermined distance (S07). Whether or not the polishing agent P has been sprayed over the predetermined range of the material B to be treated is determined by, for example, a camera, which is not shown, but no particular limitation is imposed thereby. The material B to be treated may be moved a predetermined distance without moving the vacuum blast head 10. Then, after the vacuum blast head 10 has been moved a predetermined distance, the process returns to Step S03.

On the other hand, if it is determined that the polishing agent P has been sprayed over the predetermined range of the material B to be treated (S06: YES), the supply of compressed air from the compressed air 40 is stopped. In addition, the negative internal pressure of the polishing agent tank 30 is released by opening the dump valve 32. The injection of the polishing agent P is thereby stopped, and the surface treatment step is ended. At this time, the polishing agent P that remains at the bottom portion of the recovery tank 50 falls into the polishing agent tank 30. In this manner, it is possible to reuse the polishing agent P.

Next, the effects of the surface treatment device 1 and the surface treatment method according to the present embodiment will be described with reference to FIG. 5.

Figure 5:
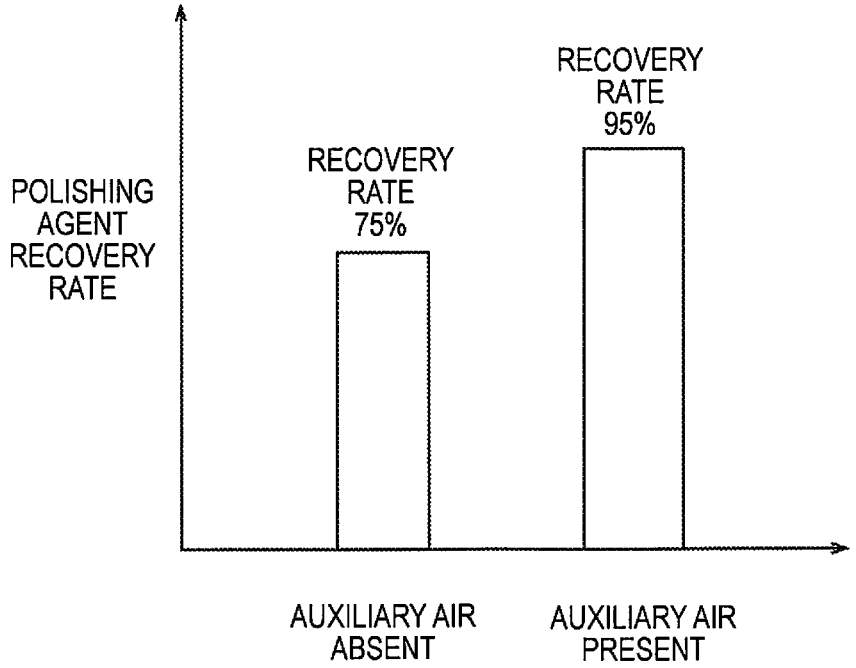
FIG. 5 is a graph illustrating the recovery rate of the polishing agent in the case in which there is auxiliary air and the case in which there is no auxiliary air.

FIG. 5 is a graph illustrating the recovery rate of the polishing agent P in a case in which there is auxiliary air HA and a case in which there is no auxiliary air HA. In FIG. 5, the horizontal axis indicates the cases with and without auxiliary air HA, and the vertical axis indicates the recovery rate of the polishing agent P.

The recovery rate of the polishing agent P for the case without auxiliary air HA was 75%, as illustrated in FIG. 5. In contrast, the recovery rate of the polishing agent P for the case with auxiliary air HA was 95%. In this manner, the recovery rate of the polishing agent P improved by injection the auxiliary air HA.

As described above, the surface treatment device 1 according to the present embodiment comprises a vacuum blast head 10, an air curtain-forming unit 16, and an auxiliary air injection unit 17. The vacuum blast head 10 comprises an injection nozzle 11 for spraying a polishing agent P used for blast treatment onto the surface B1 of the material B to be treated, and a suction hole 12 for suctioning the injected polishing P agent by suction air VA. The air curtain-forming unit 16 injects air toward the surface B1 of the material B to be treated to form an air curtain AC that surrounds the injected polishing agent P. In addition, the auxiliary air injection unit 17 injects auxiliary air HA, which has a lower pressure than the air that forms the air curtain AC, toward the material B to be treated, between the air curtain AC and the suction air VA. Thus, the space into which polishing agent P is sprayed is surrounded by the air curtain AC. Therefore, the blast space in which blast treatment is carried out can be made into an enclosed space, and it is possible to prevent the polishing agent P from being discharged from the blast space to the outside. Additionally, the auxiliary air HA is injected toward the material B to be treated between the air curtain AC and the suction air VA. Therefore, auxiliary air HA is injected onto the polishing agent P that remains between the air curtain AC and the suction air VA. At this time, since the pressure of the auxiliary air HA is lower than the pressure that forms the air curtain AC, it is possible to form a stable blast space. As a result, the remaining polishing agent P is released from a static condition and is recovered by the suction air VA via the suction hole 12. Therefore, it is possible to efficiently recover the polishing agent P. In addition, since a treatment chamber to enclose the injection nozzle 11 and the entire material B to be treated need not be provided, it is possible to prevent the device configuration from becoming complicated. Therefore, it is possible to provide a surface treatment device 1 capable of efficiently recovering a polishing agent P without complicating the device configuration.

Figure 6:
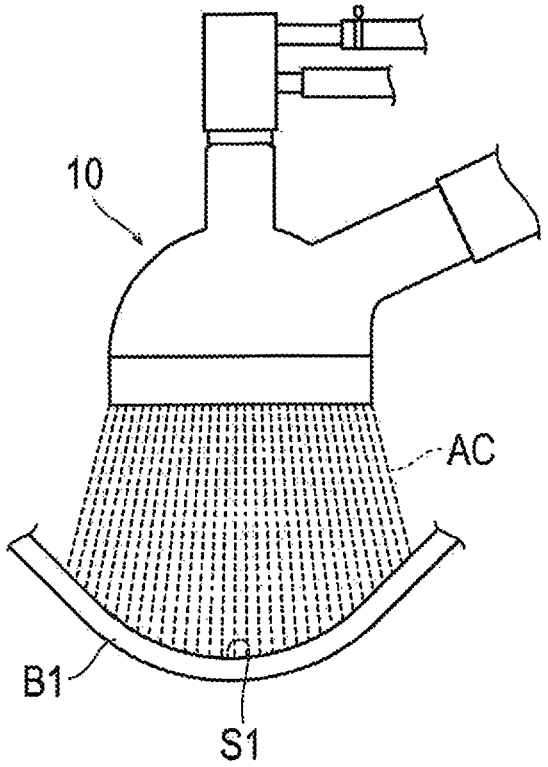
FIG. 6 is a view of the case in which the surface treatment device according to the present embodiment is applied to the material to be treated which has a curved shape.
Figure 7:
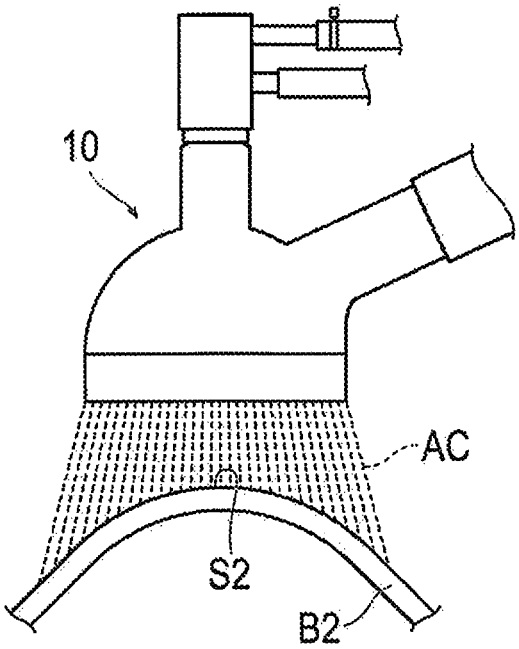
FIG. 7 is a view of the case in which the surface treatment device according to the present embodiment is applied to the material to be treated which has a curved shape.
Figure 8:
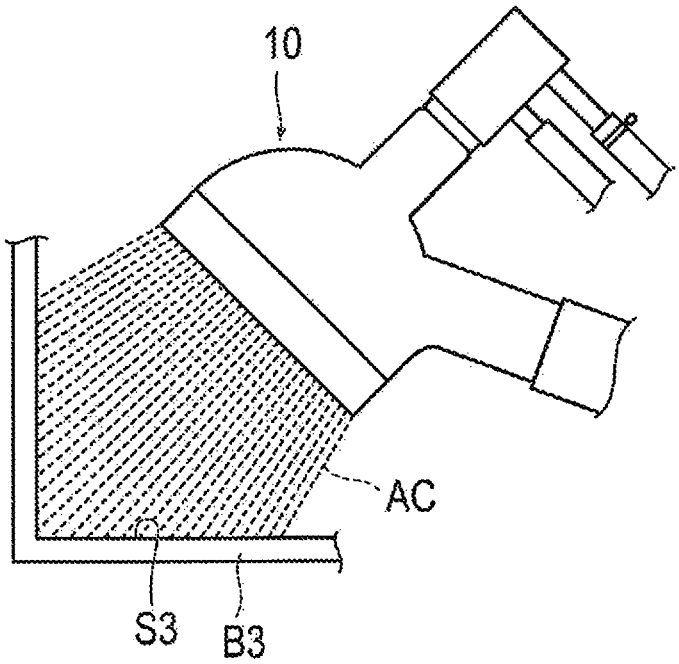
FIG. 8 is a view of the case in which the surface treatment device according to the present embodiment is applied to the material to be treated which has a bent shape.

In addition, according to the surface treatment device 1 of the present embodiment described above, with respect to curved or bent materials B1, B2, B3 to be treated, it is possible to cover blast surfaces S1, S2, S3 with the air curtain AC and the vacuum blast head 10, as illustrated in FIGS. 6-8. Therefore, it is possible to suitably carry out blast treatment on curved or bent materials B1, B2, B3 to be treated Additionally, the auxiliary air HA that is injected by the auxiliary air injection unit 17 is injected so as to incline inwardly as the auxiliary air approaches the surface B1 of the material B to be treated. Thus, the polishing agent P that remains within the blast space is moved further inwards in suitable fashion. Therefore, the recovery efficiency of the polishing agent P is further improved.

In addition, the air curtain AC formed by the air curtain-forming unit 16 is formed so as to incline outwardly as the air curtain approaches the surface B1 of the material B to be treated. Thus, it is possible to prevent interference between the air curtain AC and the auxiliary air HA, and to form a stable blast space.

Additionally, as described above, in the surface treatment method according to the present embodiment, a polishing agent used for blast treatment is sprayed onto the surface B1 of a material B to be treated, and the injected polishing agent P is drawn up with suction air VA. Air is injected toward the surface B1 of the material B to be treated to form an air curtain AC that surrounds the injected polishing agent P. Then, auxiliary air HA, which has a lower pressure than the air that forms the air curtain AC, is injected toward the material B to be treated, between the air curtain AC and the suction air VA. Thus, the space into which polishing agent P is sprayed is surrounded by the air curtain AC. Therefore, the blast space in which blast treatment is carried out can be made into an enclosed space, and it is possible to prevent the polishing agent P from being discharged from the blast space to the outside. Additionally, the auxiliary air HA is injected toward the material B to be treated between the air curtain AC and the suction air VA. Therefore, auxiliary air HA is injected onto the polishing agent P that remains between the air curtain AC and the suction air VA. At this time, since the pressure of the auxiliary air HA is lower than the pressure that forms the air curtain AC, it is possible to form a stable blast space. As a result, the remaining polishing agent P is released from a static condition, and is drawn up the suction air VA via the suction hole 12. Therefore, it is possible to efficiently recover the polishing agent P. In addition, since a treatment chamber to enclose the injection nozzle 11 and the entire material B to be treated need not be provided, it is possible to prevent the device configuration from becoming complicated. Therefore, it is possible to provide a surface treatment method with which it is possible efficiently recover a polishing agent P without complicating the device configuration.

Additionally, the auxiliary air HA is injected so as to incline inwardly as the auxiliary air approaches the surface B1 of the material B to be treated. Thus, the polishing agent P that remains in the blast space is moved further inwards in suitable fashion. Therefore, the recovery efficiency of the polishing agent P is further improved.

In addition, the air curtain AC is formed so as to incline outwardly as the air curtain approaches the surface B1 of the material B to be treated. Thus, it is possible to prevent interference between the air curtain AC and the auxiliary air HA and to form a stable blast space.

The present invention is not limited to the embodiment described above; various modifications are possible within the scope of the claims.

Figure 9:
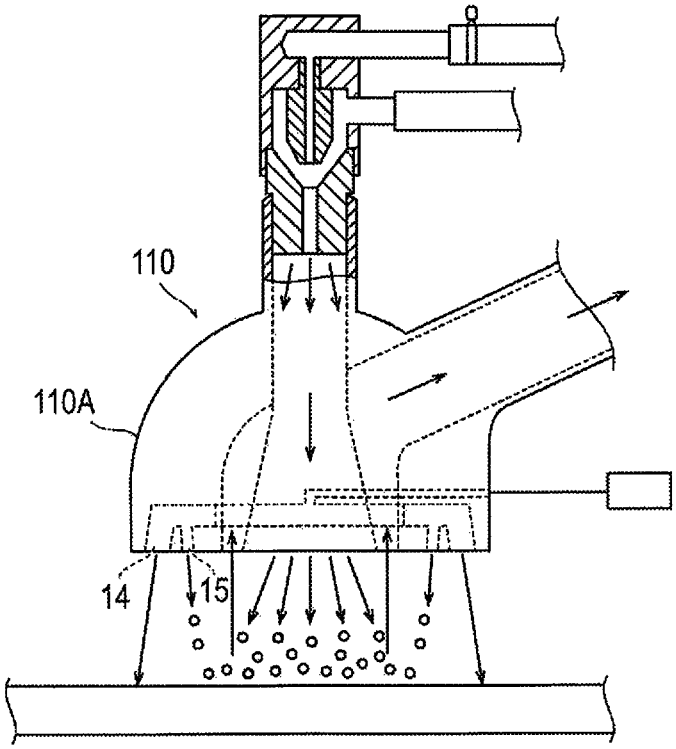
FIG. 9 is a view illustrating a vacuum blast head of a surface treatment device according to a modified example.

For example, in the embodiment described above, the air curtain-forming holes 14 and the auxiliary air injection holes 15 were provided in ring plate 13. However, the air curtain-forming holes 14 and the auxiliary air injection holes 15 may be provided in the main body 110A of the vacuum blast head 110, as illustrated in FIG. 9.

In addition, in the embodiment described above, the suction hole 12 is disposed radially outwardly with respect to the injection nozzle 11. However, the suction hole may be provided radially inward with respect to the injection nozzle.

Additionally, in the embodiment described above, the surface treatment device 1 is used for the purpose of roughening the surface B1 of the material B to be treated. However, the surface treatment device 1 may be used for the purpose of cleaning, deburring, shot peening, etc., the surface B1 of the material B to be treated.

In addition, in the embodiment described above, the air curtain-forming holes 14 and the auxiliary air injection holes 15 were provided to the vacuum blast head 10. However, the air curtain-forming holes and the auxiliary air injection holes may be provided separately from the vacuum blast head.

The invention claimed is:

1. A surface treatment device comprises:

a vacuum blast head including an injection nozzle for spraying a polishing agent for blast treatment on a surface of a material to be treated, and a suction hole for suctioning the injected polishing agent with suction air;

an air curtain-forming unit that injects air toward the surface of the material to be treated to form an air curtain that surrounds the injected polishing agent; and an auxiliary air injection unit that injects auxiliary air between the air curtain and the suction air towards the material to be treated at a lower pressure than the air forming the air curtain.

2. The surface treatment device as recited in claim 1, wherein the auxiliary air injected by the auxiliary air injection unit is inclined inwardly as the auxiliary air approaches the surface of the material to be treated.

3. The surface treatment device as recited in claim 2, wherein the air curtain formed by the air curtain-forming unit is inclined outwardly as the air curtain approaches the surface of the material to be treated.

4. The surface treatment device as recited in claim 1, wherein the air curtain formed by the air curtain-forming unit is inclined outwardly as the air curtain approaches the surface of the material to be treated.

5. A surface treatment method for spraying a polishing agent for blast treatment on a surface of a material to be treated, and suctioning the polishing agent that was injected with suction air, the method comprising:

injecting air towards the surface of the material to be treated to form an air curtain that surrounds the polishing agent that was injected; and injecting auxiliary air between the air curtain and the suction air toward the material to be treated at a lower pressure than the air that forms the air curtain.

6. The surface treatment method recited in claim 5, wherein the auxiliary air is injected so as to incline inwardly as the auxiliary air approaches the surface of the material to be treated.

7. The surface treatment method recited in claim 5, wherein the air curtain is formed so as to incline outwardly as the air curtain approaches the surface of the material to be treated.

8. The surface treatment method recited in claim 5, wherein the air curtain is formed so as to incline outwardly as the air curtain approaches the surface of the material to be treated.

* * * * *